US009192227B2

(12) United States Patent
Stein et al.

(10) Patent No.: US 9,192,227 B2
(45) Date of Patent: Nov. 24, 2015

(54) APPARATUS FOR PRODUCING BRISTLE ARRANGEMENTS FOR BRUSHES

(75) Inventors: Bernd Stein, Kirchzarten (DE); Bernhard Rees, Aitern (DE); Ingo Kumpf, Todtnau (DE); Florian Kiefer, Frohnd (DE)

(73) Assignee: ZAHORANSKY AG, Todtnau (DE)

( * ) Notice: Subject to any disclaimer, the term of this patent is extended or adjusted under 35 U.S.C. 154(b) by 504 days.

(21) Appl. No.: 13/641,152

(22) PCT Filed: Mar. 18, 2011

(86) PCT No.: PCT/EP2011/001343

§ 371 (c)(1),
(2), (4) Date: Oct. 15, 2012

(87) PCT Pub. No.: WO2011/128020

PCT Pub. Date: Oct. 20, 2011

(65) Prior Publication Data

US 2013/0038115 A1 Feb. 14, 2013

(30) Foreign Application Priority Data

Apr. 16, 2010 (DE) ..... 10 2010 015 118

(51) Int. Cl.
*A46D 3/04* (2006.01)
*A46D 1/08* (2006.01)

(52) U.S. Cl.
CPC *A46D 3/045* (2013.01); *A46D 1/08* (2013.01); *A46D 3/04* (2013.01)

(58) Field of Classification Search
CPC ..... A46D 3/082; A46D 1/08; A46D 1/04; A46D 3/042; A46D 3/06; A46D 3/00
USPC ..... 300/5, 6, 7, 8, 10, 11
See application file for complete search history.

(56) References Cited

U.S. PATENT DOCUMENTS

| | | | | |
|---|---|---|---|---|
| 3,048,442 | A * | 8/1962 | Anderson | 300/7 |
| 2001/0026093 | A1 * | 10/2001 | Boucherie | 300/5 |

FOREIGN PATENT DOCUMENTS

| | | |
|---|---|---|
| DE | 3405001 | 8/1985 |
| DE | 10138339 | 8/2002 |
| EP | 0405204 | 6/1990 |
| WO | 2010105745 | 9/2010 |

* cited by examiner

*Primary Examiner* — Robert Scruggs
(74) *Attorney, Agent, or Firm* — Volpe and Koenig, P.C.

(57) ABSTRACT

An apparatus (1) for producing bristle arrangements for brushes, in particular toothbrushes, having a bristle supply (2) and an apparatus (3) for extracting individual bundles (4) of bristles from the bristle supply (2), and also having a transporting apparatus for transporting the bundles (4) of bristles by way of at least one hollow line (8) by means of a stream of gas or air in perforations in a bundle-retaining plate, is characterized in that the apparatus (3) for extracting the bundles (4) of bristles from the bristle supply (2) has at least one bundle holder (6), and in that the bundle holder(s) (6) of the extraction means (3), the inner contour (10) of the hollow line(s) (8) and the perforations in the bundle-retaining plate are each contoured in a manner corresponding to the bundle contour which is desired in the bristle arrangement.

7 Claims, 3 Drawing Sheets

APPARATUS FOR PRODUCING BRISTLE ARRANGEMENTS FOR BRUSHES

BACKGROUND

The invention relates to an apparatus for producing bristle arrangements for brushes, in particular toothbrushes, having a bristle supply and having an apparatus which is intended for removing individual clusters of bristles from the bristle supply and has at least one cluster holder, and having a transporting apparatus for transporting the clusters of bristles through at least one hollow line, by means of a gas stream or air stream, into perforations of a cluster-retaining plate, these perforations, for accommodating a cluster of bristles transported in a hollow line, being contoured in each case to correspond to the desired cluster contour.

Such an apparatus is known, for example, from EP 0 405 204 B1. A plurality of clusters of filaments here are transported into a carrier plate via hoses. The clusters of filaments are then fused to a thermoplastic carrier plate and/or encapsulated in plastic material by injection molding to form a brush head. The individual clusters of bristles here each have a round cross section. In particular in the case of toothbrushes nowadays, however, there is a desire to have more complex bristle arrangements in which at least individual clusters of bristles have a non-circular cross section, for example a rectangular or triangular cross section.

Numerous further publications, for example DE 101 08 339 A1 or DE 34 05 001 A1, also disclose apparatuses and methods for transferring clusters of bristles into cluster-retaining plates in order to form a bristle arrangement. The individual clusters of bristles here, however, likewise always have a round, circular cross section.

SUMMARY

It is therefore an object to create an apparatus of the type mentioned in the introduction in which it is easily possible to form bristle arrangements with clusters of bristles of any desired contour.

This object is achieved according to the invention in that the inner contour of the hollow line(s), en route to the discharging end of the hollow line, changes contour to a cluster contour which is desired in the bristle arrangement. There is no need for complex shaping of the cluster of bristles by the cluster of bristles being transferred from one retaining plate to a further retaining plate with appropriately contoured accommodating openings with the aid of complex-design transfer devices. Rather, the cluster of bristles is contoured during transportation in the hollow line, and there is no need for additional shaping apparatuses or any additional space.

Once they have been put together to form a bristle arrangement, the clusters of bristles are encapsulated in plastic material by injection molding to form a brush head. In order to prevent the situation here where the high injection pressure causes injection material to pass through the filaments of the clusters of bristles and become visible on the brush surface, which is unsightly or may render the brush unusable, it is expedient if the cluster-retaining plate has arranged downstream of it a compressor plate, which has perforations which are intended for accommodating clusters of bristles and of which the cross sections are each smaller than the cross section of the cluster of bristles supplied to the respective perforations, and if an apparatus is provided for advancing the clusters of bristles from the cluster-retaining plate to the compressor plate.

As the clusters of bristles are being transferred into the compressor plate, the clusters of bristles are themselves compressed, that is to say the entire cluster of bristles has its outer circumference reduced somewhat, and there is therefore a reduction in the spacing between the individual bristle filaments of a cluster of bristles. It is therefore possible, when the clusters of bristles are then being encapsulated in plastic material by injection molding to form a brush head, or the brush body as a whole, to use high injection pressure without there being any risk of injection material pushing outwards through the clusters of bristles and the brush thus becoming unusable.

In order to supply the clusters of bristles to the cluster-retaining plate, the transporting apparatus may have a hollow line for a cluster of bristles. The discharging end of the hollow line and the cluster-retaining plate can be positioned relative to one another in order for all the perforations of the cluster-retaining plate to be filled with clusters of bristles one after the other.

In order to make it possible for all the perforations of the cluster-retaining plate to be filled with clusters of bristles more quickly, it is expedient if the transporting apparatus has a number of hollow lines which matches the number of perforations of the cluster-retaining plate. It is thus possible for all the perforations to be filled at the same time.

A cost-effective construction of straightforward design is achieved if the hollow lines are hoses made of flexible material. In particular use can be made of hoses made of plastic material.

It is also possible, however, for the hollow lines to be tube joints made of steel, stainless steel or some other metal. Plastic-material hoses require a certain material thickness in order to be able to withstand the pressure as clusters are being transported by means of a gas stream or air stream. In the case of hollow lines made of metal, the material thickness, and thus the external diameter, thereof may be smaller, and therefore they can have their ends arranged more closely together and the perforations of the cluster-retaining plate may likewise be closer together. It is thus possible for the cluster-retaining plate to have smaller dimensions overall, which reduces the amount of space required for the apparatus and it is possible to provide bristle arrangements with clusters of bristles arranged closer together.

The cluster-retaining plate may be a brush sub-body, an injection-mold insert or an intermediate plate which can be transferred to a further-processing device.

In brush sub-body form, the cluster-retaining plate serves for accommodating the clusters of bristles and, when the cluster ends are being encapsulated by injection molding, itself becomes part of the finished brush.

As an injection-mold insert, the cluster-retaining plate is inserted, with the clusters of bristles retained in it, into an injection mold and, once the cluster ends have been encapsulated by injection molding, the cluster-retaining plate is removed from the clusters of bristles and the then finished brush.

If the cluster-retaining plate is designed as an intermediate plate, it is possible for it to be transferred to a further-processing device and, there, to be transferred to a brush sub-body, an injection-mold insert or in the first instance, as described above, to a compressor plate.

Using hoses, but also tube joints made of metal, as a hollow line for transporting the clusters of bristles gives rise to geometrical problems in producing closely packed bristle arrangements, since the hollow lines have to be fastened at the discharging end, and space is required for this purpose. The smallest possible spacing between perforations here is limited, in addition, by the material thickness of the hollow lines.

In order to produce brushes with bristle arrangements of which the clusters of bristles are arranged in a very closely packed manner, it is thus advantageous if the plurality of hollow lines of the transporting apparatus each open out into a guide channel of a guide element, wherein the guide channels are each designed as through-passage openings, and the spacings between the guide channels are smaller on the discharging side than the spacings on the supply side.

At the supply end, the spacings between the guide channels may be larger, in order to allow reliable connection of the hollow lines. As they progress, it is possible for the guide channels to get closer to one another and, at the discharging end, to be arranged very close together. Since there is no need for any connection locations at the discharging end, the spacing between the guide channels is limited merely by the technique used for producing the guide element.

The guide element may be formed in one or more parts. For example, the guide element may comprise two sub-blocks, wherein a first sub-block has guide channels which are rectilinear, but run toward one another in a funnel-shaped manner, in order to reduce the spacing between the perforations and an adjoining, second sub-block has guide channels which run parallel to one another.

BRIEF DESCRIPTION OF THE DRAWINGS

The apparatus according to the invention will be explained in more detail hereinbelow with reference to the drawings, in which, in parts schematically.

DETAILED DESCRIPTION OF THE PREFERRED EMBODIMENTS

Figures 1, 2, 3, 4, 5, 6, 7, 8, 9, 10, 11, 12, 13:
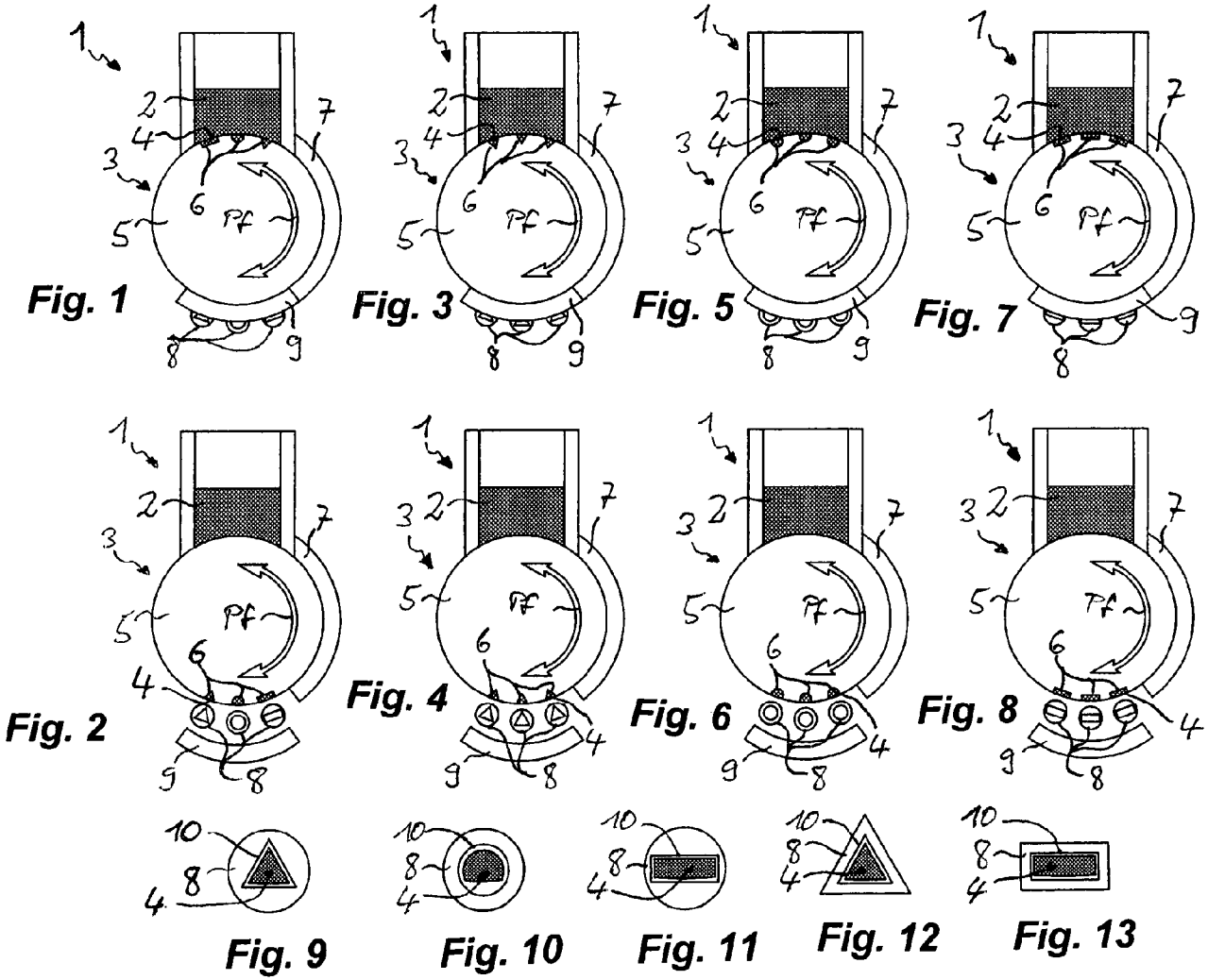
FIGS. 1 to 8 each show an apparatus having a bristle supply and circular disk for removing individual clusters of bristles from the bristle supply.
FIGS. 9 to 13 show hollow lines with difference inner contours.

An apparatus which is designated as a whole by 1 and is intended for producing bristle arrangements for brushes, in particular toothbrushes, has, according to FIGS. 1 to 8, a bristle supply 2 and an apparatus 3 for removing individual clusters of bristles 4 from the bristle supply 2. The removal apparatus 3 here has a circular disk 5 with three cluster holders 6 as cluster separators. The circular disk 5 can be pivoted (arrow Pf) in each case between a cluster-accommodating position (FIGS. 1, 3, 5 and 7) and a cluster-discharging position (FIGS. 2, 4, 6 and 8).

In the case of the apparatus 1 according to FIGS. 1 and 2, the individual cluster holders 6 have different contours (rectangular, circular, triangular), whereas the circular disks 5 of the removal apparatuses 3 according to FIGS. 3 and 4 (triangular), 5 and 6 (circular) and 7 and 8 (rectangular) have cluster holders 6 each of identical contours.

Once the clusters of bristles 4 have been removed from the bristle supply 2, the circular disk 5 is pivoted through 180°, wherein the cluster holders 6 run past a fixed counterpart 7, this avoiding the situation where the clusters of bristles 4 fall out of the cluster holders 6. In a transfer position of the circular disk 5 (FIGS. 2, 4, 6 and 8), the clusters of bristles 4 are transferred, by way of a transfer device (not illustrated), into hollow lines 8 of a transporting apparatus (not illustrated any further). For this purpose, a movable counterpart 9 is moved into a position in which it is spaced apart from the circular disk 5, in order to release the cluster holders 6.

FIGS. 9 to 13 illustrate enlarged cross sections of hollow lines 8, which make it clear to see how the inner contour 10, at the supply end, of these hollow lines are matched to the contour of the cluster of bristles 4. Whereas the hollow lines 8 according to FIGS. 9 to 11 have a round outer cross section, according to FIGS. 12 and 13 it is also the case that the outer contour of the hollow line 8 is matched to the inner contour. It is thus possible to reduce the materials-related outlay for the hollow line 8.

FIGS. 14 to 17 each show, partly in section, a hollow line 8 in which the inner contour 10 of the hollow line 8, en route from the introduction end 11, which is directed toward the removal apparatus, to the discharging end 12 of the hollow line 8, changes contour to a cluster contour which is desired in the bristle arrangement. The clusters of bristles 4 here are removed from the bristle supply 2 in each case by way of approximately circular-contour cluster holders 6 corresponding to FIGS. 5 and 6 and are transferred to the hollow lines 8, where they are shaped, during transportation, in accordance with the changing inner contour 10.

Figure 17:
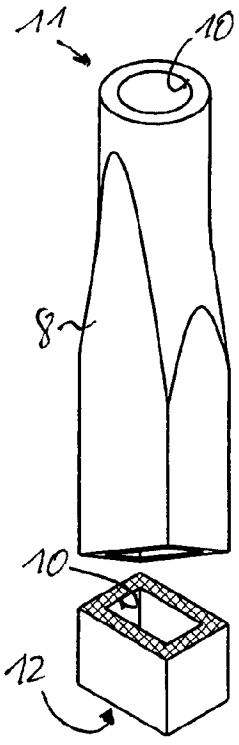
FIGS. 14 to 17 show hollow lines with an inner contour which changes from the introduction end to the discharging end.
Figure 16:
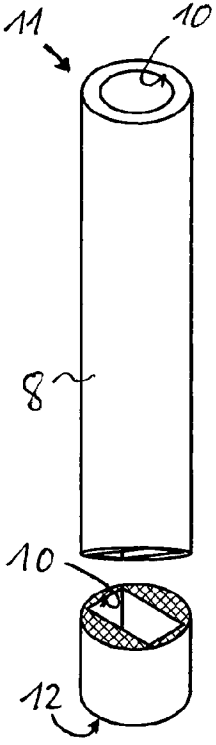
Figure 15:
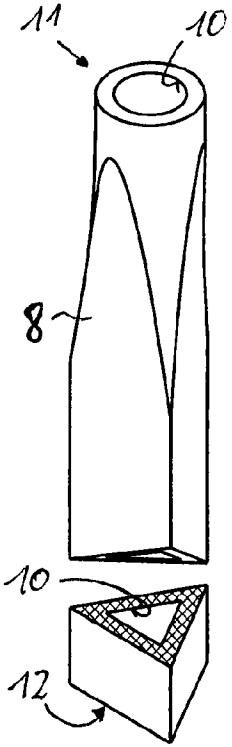
Figure 14:
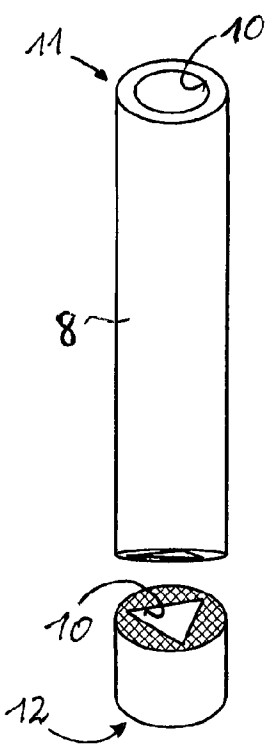

In the case of the hollow lines 8 according to FIGS. 15 and 17, the outer contour also changes from the introduction end 11 to the discharging end 12, and this reduces the amount of materials required for the hollow line 8.

As in the case of the exemplary embodiments according to FIGS. 1 to 8, the contoured clusters of bristles 4 of the exemplary embodiments according to FIGS. 14 to 17 are introduced from the hollow lines 8 into appropriately contoured perforations of a cluster-retaining plate (not illustrated).

As is evident, in particular, from the illustrations according to FIGS. 14 to 17, the hollow lines 8 have a certain material thickness, as a result of which the closeness together of the perforations of an adjoining cluster-retaining plate is limited.

Figure 18:
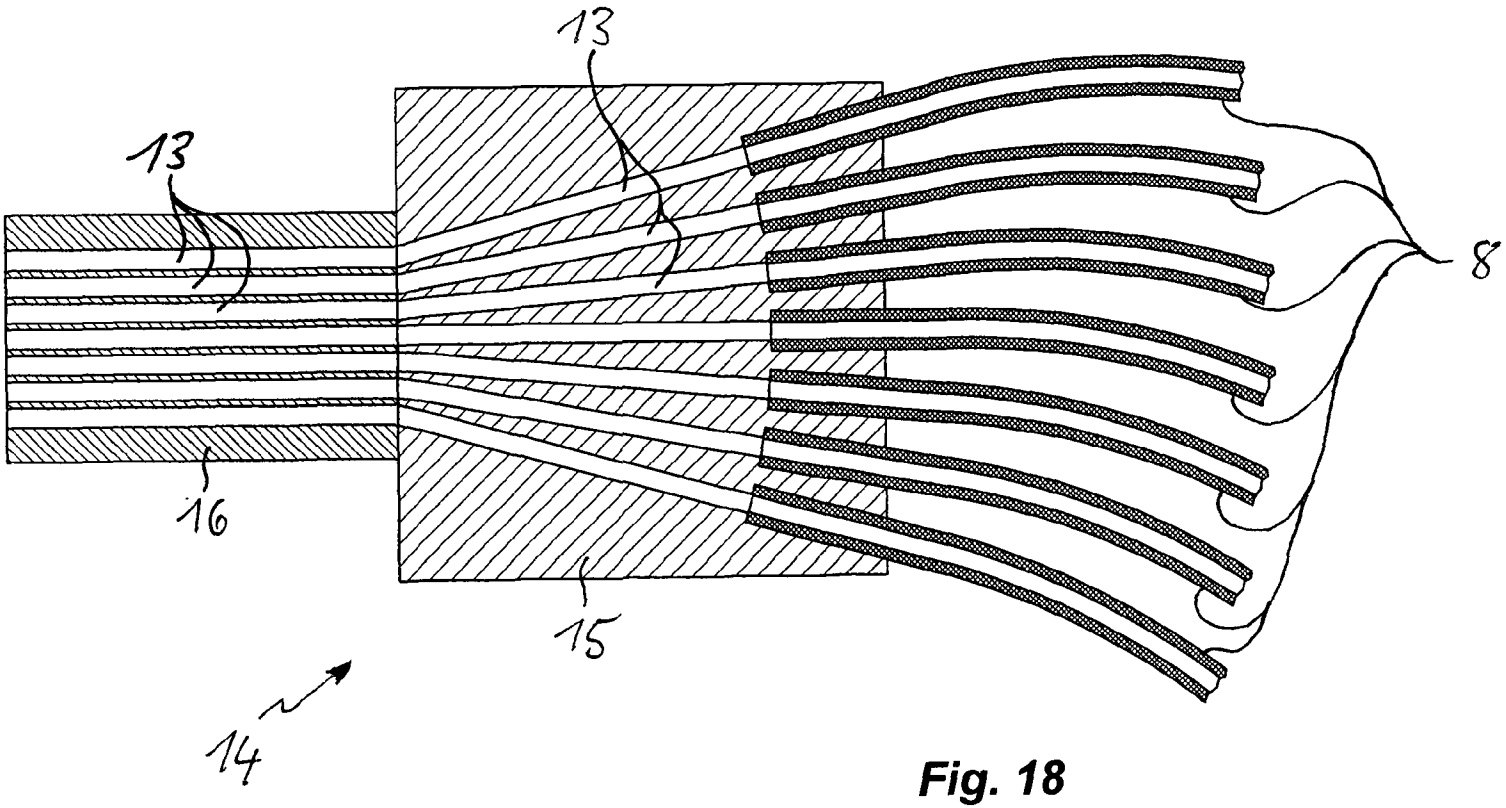
FIG. 18 shows a guide element with guide channels.

In order to increase the cluster density of a brush, and to be able to arrange the perforations of the cluster-retaining plate closer together, it is possible, as illustrated in FIG. 18, for the plurality of hollow lines 8 of the transporting apparatus each to open out into a guide channel 13 of a guide element 14, wherein the guide channels 13 are each designed as through-passage openings, and the spacings between the guide channels 13 on the discharging side are smaller than the spacings on the supply side.

On the supply side, the spacings between the guide channels 13 are larger, in order to allow reliable connection of the hollow lines 8. In the exemplary embodiment, the hollow lines 8 are introduced into widened-cross-section holders of the guide element 14. As they progress, the guide channels 13 get closer to one another and, at the discharging end, they are arranged very close together. Since there is no need for any connection locations at the discharging end, the spacing between the guide channels 13 is limited merely by the technique used for producing the guide element 14.

The guide element 14 according to FIG. 18 is of multi-part design, having a first sub-block 15 with guide channels 13 which are rectilinear, but run toward one another in a funnel-shaped manner, for reducing the spacing between the perforations, and having an adjoining, second sub-block 16 with guide channels 13 which run parallel to one another.

The invention claimed is:

1. An apparatus for producing bristle arrangements for brushes, comprising a bristle supply (2) and having an apparatus (3) which is adapted to remove individual clusters of bristles (4) from the bristle supply (2) and has at least one cluster holder (6), and a transporting apparatus for transporting the clusters of bristles (4) through at least one hollow line (8) by a gas stream or air stream, into perforations of a cluster-retaining plate, the perforations, for accommodating a cluster of bristles (4) transported in a hollow line (8), being contoured in each case to correspond to a desired cluster contour, an inner contour (10) of the hollow line (8), en route to a discharging end (12) of the hollow line (8), changes contour to a cluster contour which is desired in the bristle arrangement.

2. The apparatus as claimed in claim 1, wherein a compressor plate is arranged downstream of the cluster-retaining plate, the compressor plate, which has perforations which are intended for accommodating the clusters of bristles (4) and cross sections of said compressor plate perforations are each smaller than a cross section of the cluster of bristles (4) supplied to the respective compressor plate perforations, and an apparatus is provided for advancing the clusters of bristles (4) from the cluster-retaining plate to the compressor plate.

3. The apparatus as claimed in claim 1, wherein the transporting apparatus has a plurality of the hollow lines (8) which matches a number of the perforations of the cluster-retaining plate.

4. The apparatus as claimed in claim 3, wherein the hollow lines (8) are hoses made of flexible material.

5. The apparatus as claimed in claim 3, wherein the plurality of hollow lines (8) of the transporting apparatus each open out into a guide channel (13) of a guide element (14), guide channels (13) are each designed as through-passage openings, and spacings between the guide channels (13) are smaller on a discharging side than spacings between the guide channels on a supply side.

6. The apparatus as claimed in claim 1, wherein the hollow lines (8) are tube joints made of steel, stainless steel or another metal.

7. The apparatus as claimed in claim 1, wherein the cluster-retaining plate is a brush sub-body, an injection-mold insert, or an intermediate plate which can be transferred to a further-processing device.

* * * * *